US007118406B2

(12) United States Patent
Mu et al.

(10) Patent No.: US 7,118,406 B2
(45) **Date of Patent: *Oct. 10, 2006**

(54) SOCKET CONNECTING STRUCTURE

(75) Inventors: Hsien-Chung Tuan Mu, Taichung (TW); Sammy Tsai, Taichung (TW)

(73) Assignee: Lea Way Hand Tool Corporation, (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/054,626

(22) Filed: Feb. 9, 2005

(65) Prior Publication Data

US 2006/0178036 A1 Aug. 10, 2006

(51) Int. Cl.
*H01R 11/20* (2006.01)

(52) U.S. Cl. ..... 439/419; 211/70.6

(58) Field of Classification Search ..... 439/419, 439/575; 211/70.6, 94.01

See application file for complete search history.

(56) References Cited

U.S. PATENT DOCUMENTS

| | | | | |
|---|---|---|---|---|
| 6,386,363 | B1 * | 5/2002 | Huang | 206/378 |
| 6,450,338 | B1 * | 9/2002 | Chen | 206/378 |
| 2005/0230335 | A1 * | 10/2005 | Chiu et al. | 211/70.6 |
| 2005/0230587 | A1 * | 10/2005 | Yang | 206/378 |
| 2006/0151406 | A1 * | 7/2006 | Hsien-Chung et al. | 211/70.6 |

* cited by examiner

*Primary Examiner*—Tulsidas C. Patel
*Assistant Examiner*—Phuongchi Nguyen

(57) ABSTRACT

A socket connecting structure includes a connecting portion disposed on a suspension element and a stub extending from the connecting portion, wherein the stub is connected to a socket. The stub has a resilient stick formed on one side thereof and a spring formed within the stub. The spring has one end connected to an inner periphery of the stub and abuts a back of the resilient stick to provide a thrust to the resilient stick for connecting the socket when the resilient stick is worn out.

3 Claims, 6 Drawing Sheets

SOCKET CONNECTING STRUCTURE

BACKGROUND OF THE INVENTION

1. Field of the Invention

The present invention relates to a connecting structure, and more particularly to a socket connecting structure.

2. Description of Related Art

As well known, the socket is attached to the socket rack due to a friction force between the socket and the socket rack. Consequently, the connection between the socket and the socket rack may be weakened and extremely, the socket may be detached from the socket rack when the socket rack is worn out.

The present invention has arisen to mitigate and/or obviate the disadvantages of the conventional socket connecting structure.

SUMMARY OF THE INVENTION

The main objective of the present invention is to provide an improved socket connecting structure that has a lengthened use life.

To achieve the objective, the socket connecting structure in accordance with the present invention comprises a connecting portion disposed on a suspension element and a stub extending from the connecting portion, wherein the stub is connected to a socket. The stub has a resilient stick formed on one side thereof and a spring formed within the stub. The spring has one end connected to an inner periphery of the stub and abuts a back of the resilient stick to provide a thrust to the resilient stick for connecting the socket when the resilient stick is worn out.

Further benefits and advantages of the present invention will become apparent after a careful reading of the detailed description with appropriate reference to the accompanying drawings.

DETAILED DESCRIPTION OF THE INVENTION

Figure 1:
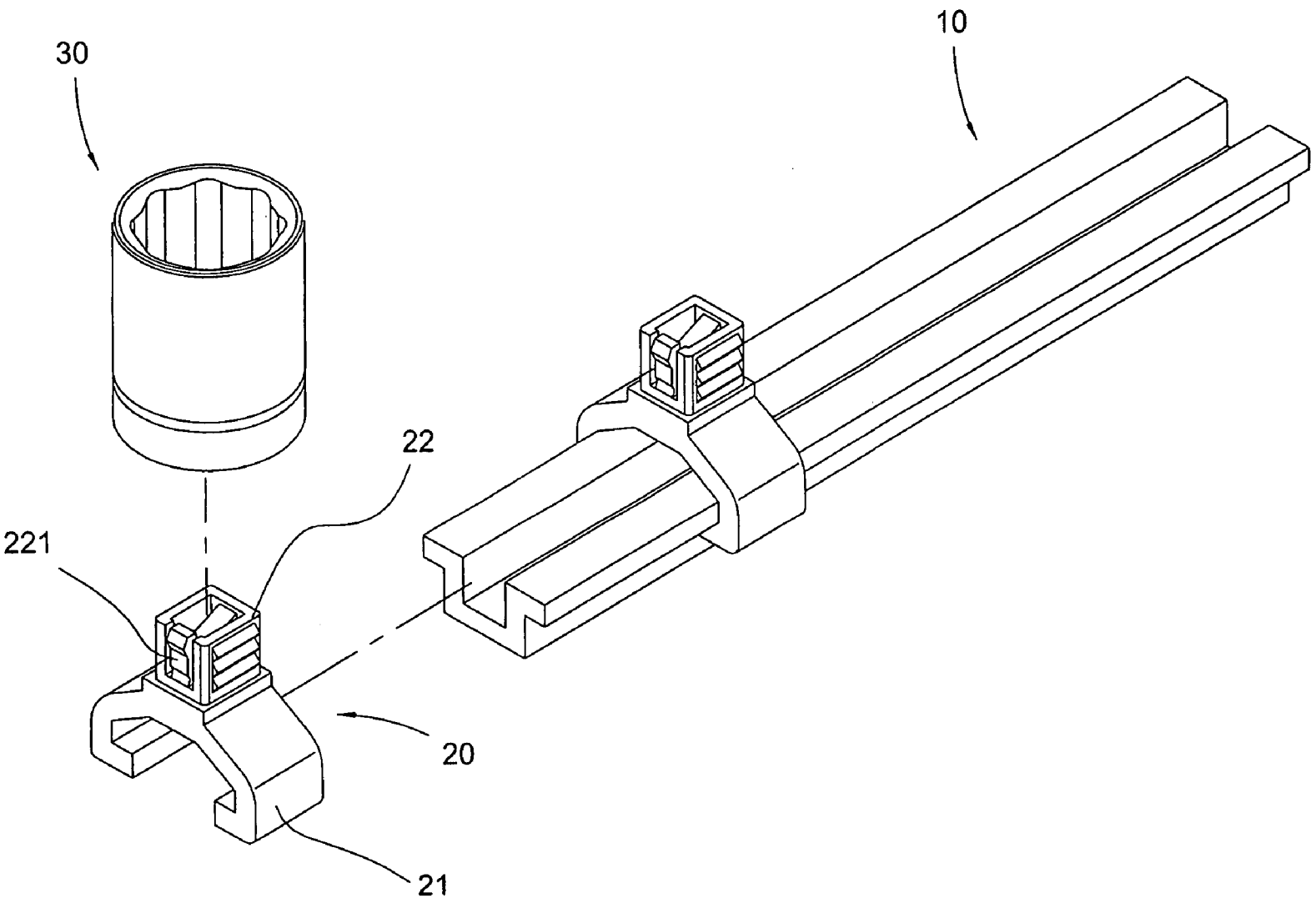
FIG. 1 is an exploded perspective schematic view of a socket connecting structure in accordance with the present invention.
Figure 2:
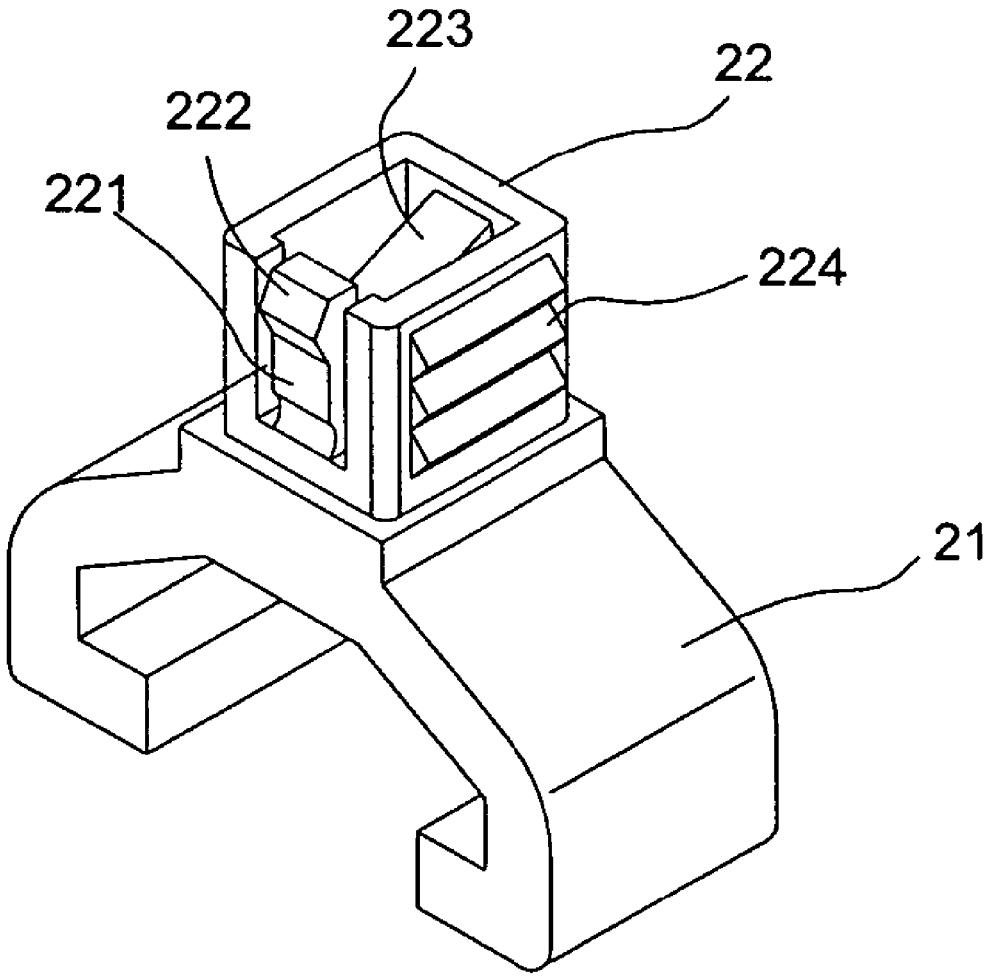
FIG. 2 is a perspective view of the socket connecting structure in accordance with the present invention.
Figure 3:
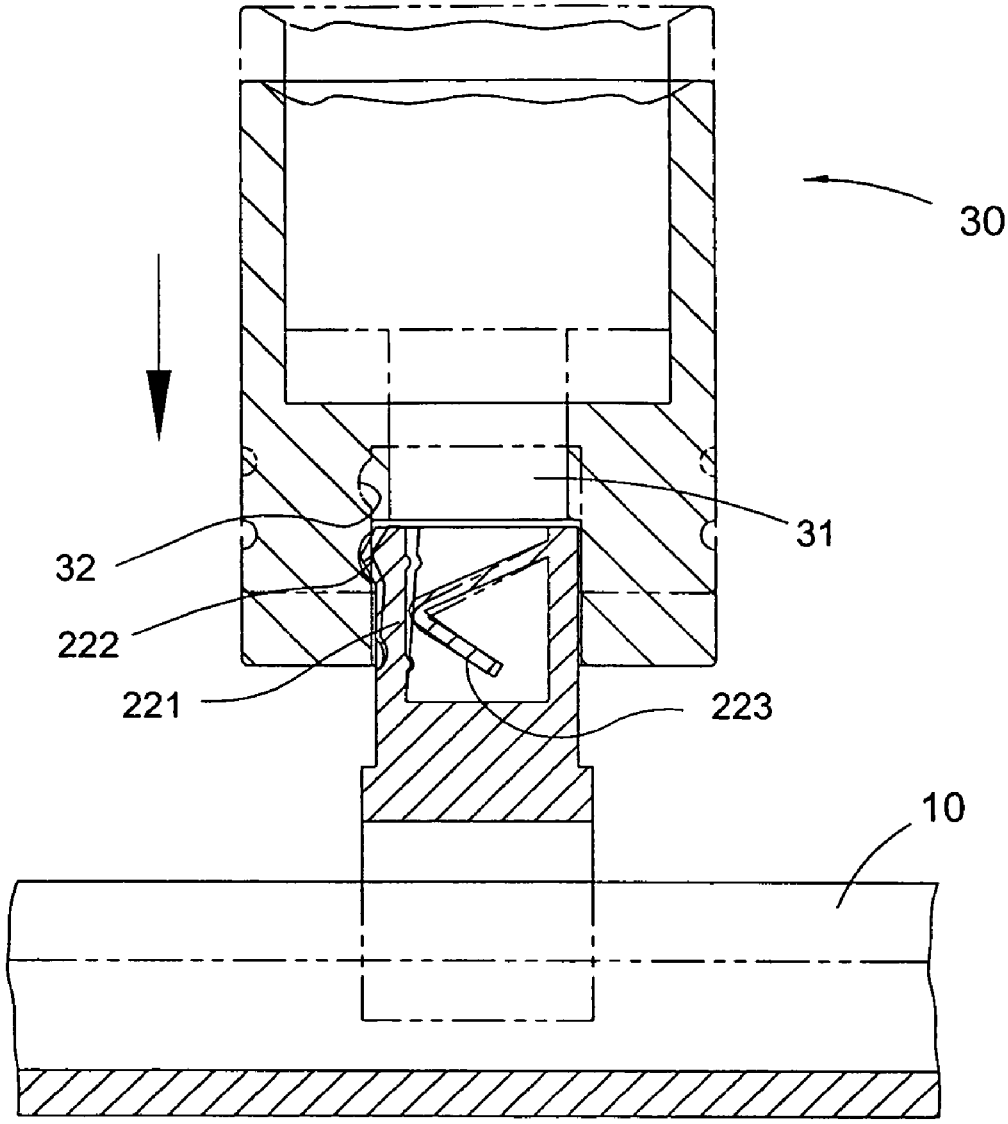
FIG. 3 is an operational view in cross-section of the socket connecting structure in FIG. 2.
Figure 4:
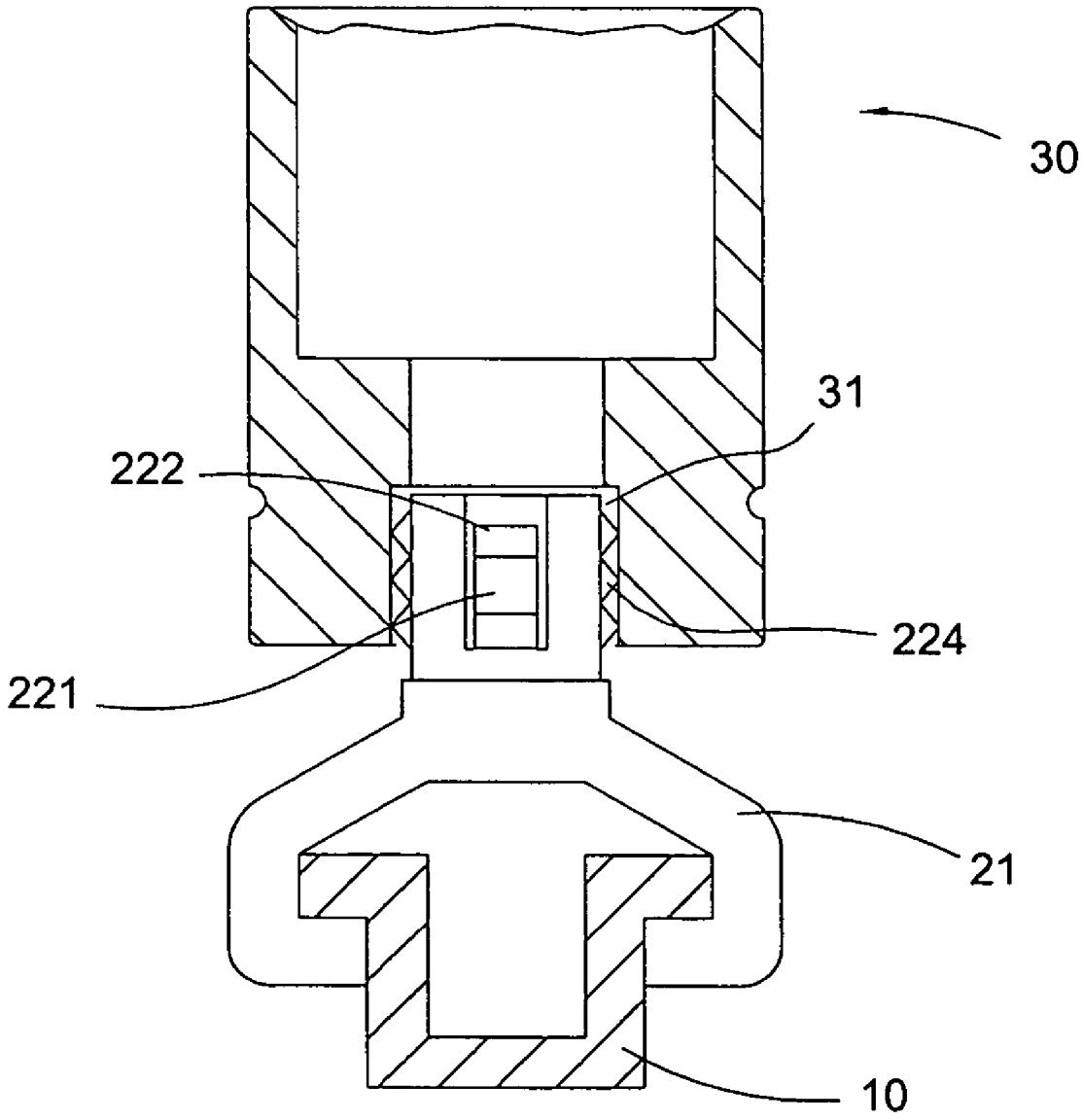
FIG. 4 is a second operational view of the socket connecting structure of the present invention when the socket is arranged to a right position.

Referring to the drawings and initially to FIGS. 1–4, a socket connecting structure in accordance with the present invention comprises a connecting portion (21) slidably mounted on a suspension rack (10) and a stub (22) extending from the connecting portion (21). The stub (22) is adapted to be connected to a socket. The connecting portion (21) has a dove-tail structure.

The stub (22) has a hollow structure and a resilient stick (221) formed on one side of the stub (22). The resilient stick (221) has a boss (222) formed on a free end thereof opposite to the connecting portion (21). A spring (223) is formed within the stub (22). The spring (223) has one end connected to an inner periphery of the stub (22) and abuts a back of the resilient stick (221). At least one side of the stub (22) adjacent to the resilient stick (221) has a teethed structure (224) formed thereon for promoting the friction between the socket (30) and the stub (22).

When mounting the socket (30) to the stub (22) of the present invention, the inner periphery of a cubic hole (31), which is defined in one end of the socket (30), inward pushes the resilient stick (221) to compress the spring (223) due to the boss (222). The boss (222) is received in an indentation (32) that is defined in the inner periphery of the cubic hole (31) of the socket to hold the socket in place when the socket (30) is moved to the specific location. The restitution force of the spring (223) provides a thrust to the resilient stick (221) for connecting the socket when the boss (222) of the resilient stick (221) is worn out.

Figure 5:
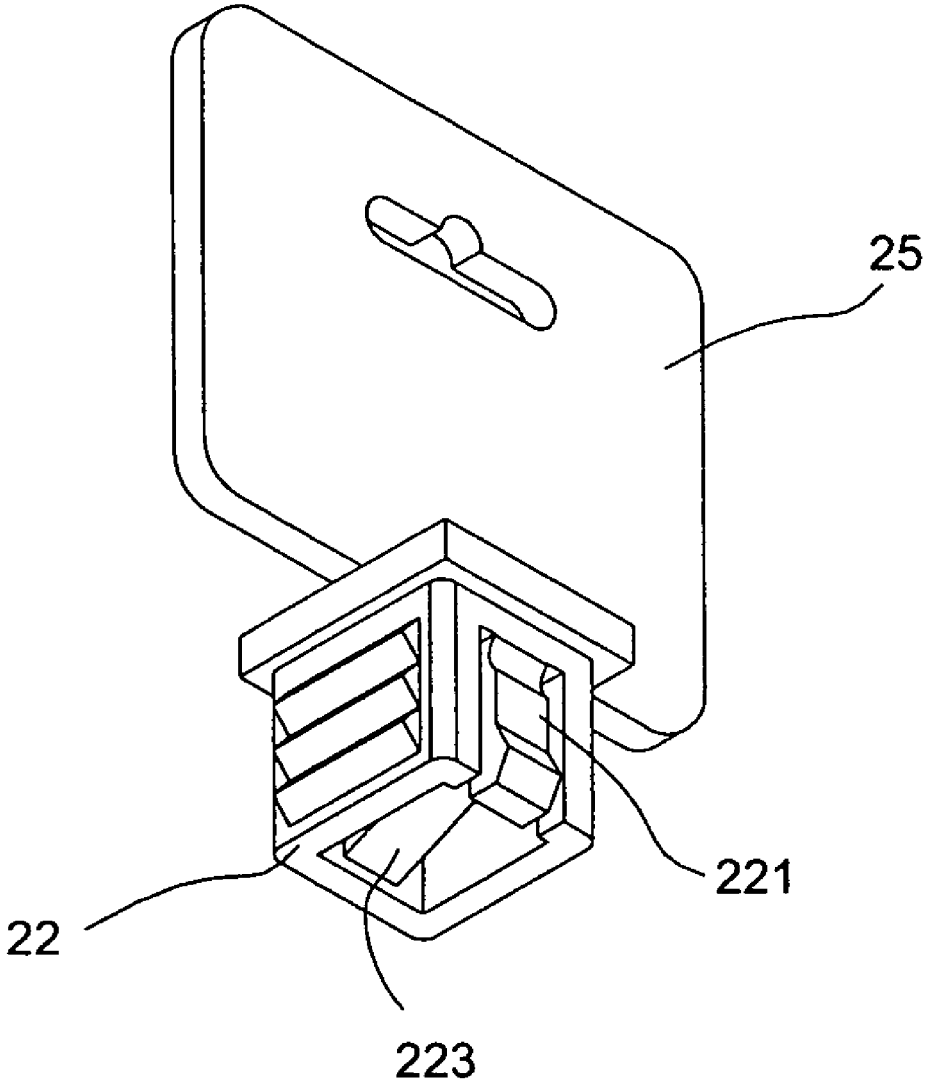
FIG. 5 is a perspective view of a second embodiment of the socket connecting structure in accordance with the present invention.

With reference to FIG. 5 that shows a second embodiment of the socket connecting structure in accordance with the present invention, the connecting portion (21) is altered to be a suspension card (25) and the stub (22) is connected to a lower portion of the suspension card (25). Consequently, the socket (30) can be displayed in a market when being connected to the stub (22).

Figure 6:
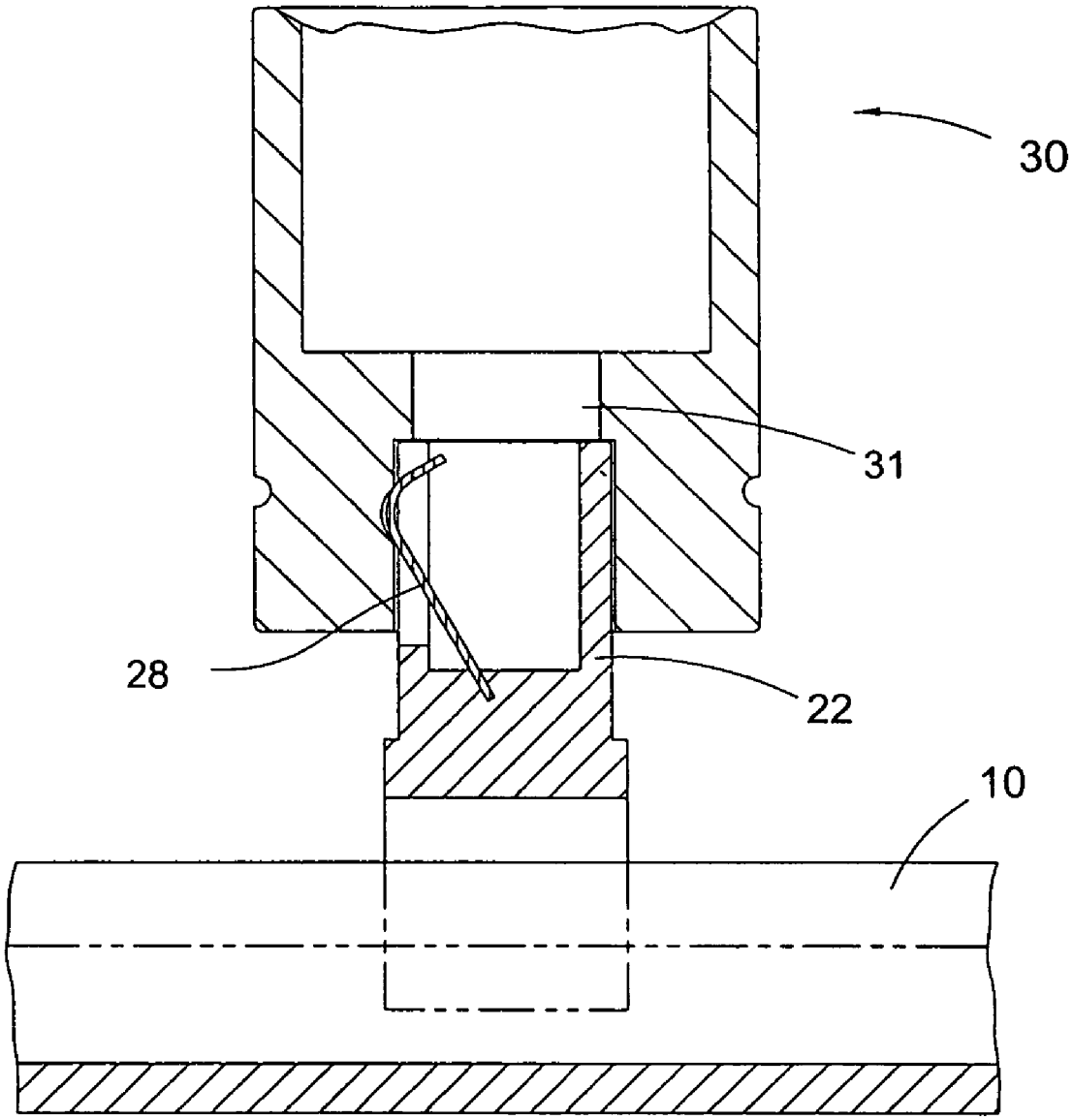
FIG. 6 is a cross-sectional schematic view of a third embodiment of the socket connecting structure in accordance with the present invention.

With reference to FIG. 6 that shows a third embodiment of the socket connecting structure in accordance with the present invention, a metal stick (28) has a first end securely inserted into a bottom of the stub (22) and a curved second end. The curved second end of the metal stick (28) is received in an indentation (32) that is defined in the inner periphery of the cubic hole (31) of the socket to hold the socket (30) in place when the socket is moved to the specific location.

Although the invention has been explained in relation to its preferred embodiment, it is to be understood that many other possible modifications and variations can be made without departing from the spirit and scope of the invention as hereinafter claimed.

What is claimed is:

1. A socket connecting structure comprising a connecting portion adapted to be disposed on a support element and a stub extending from the connecting portion and being an integral with the stub, wherein the stub is generally adapted to be confined within a cubic hole of a socket, the stub having three continuous side walls which defined only one side opening, a resilient stick disposed in the side opening and a spring formed within the stub opposite to the side opening, at least one of the three side walls having a teethed structure formed thereon for promoting the friction between the socket and the stub, the spring having one end extending from an inner periphery of the stub and another end abutting a back of the resilient suck to provide a thrust to the resilient stick for connecting the socket.

2. The socket connecting structure as claimed in claim 1, wherein the support element is a rack, and the connecting portion has a dove-tail structure which is adapted to be slidably mounted on the rack.

3. The socket connecting structure as claimed in claim 1, wherein the connecting portion is a suspension card for displaying the socket.

* * * * *